US009192004B2

(12) United States Patent
Chen

(10) Patent No.: US 9,192,004 B2
(45) Date of Patent: Nov. 17, 2015

(54) HIGH-EFFICIENCY LED DRIVER AND DRIVING METHOD

(71) Applicant: Silergy Semiconductor Technology (Hangzhou) LTD, Hangzhou, ZheJiang Province (CN)

(72) Inventor: Wei Chen, Saratoga, CA (US)

(73) Assignee: Silergy Semiconductor Technology (Hangzhou) LTD, Hangzhou (CN)

( * ) Notice: Subject to any disclaimer, the term of this patent is extended or adjusted under 35 U.S.C. 154(b) by 213 days.

(21) Appl. No.: 13/936,392

(22) Filed: Jul. 8, 2013

(65) Prior Publication Data

US 2014/0021874 A1 Jan. 23, 2014

(30) Foreign Application Priority Data

Jul. 19, 2012 (CN) ..... 2012 1 0250046

(51) Int. Cl.
*H05B 33/08* (2006.01)

(52) U.S. Cl.
CPC ..... *H05B 33/0815* (2013.01)

(58) Field of Classification Search
CPC ..... H05B 33/0845; H05B 33/0815
USPC ..... 315/307, 210, 226, 246, 297, 308
See application file for complete search history.

(56) References Cited

U.S. PATENT DOCUMENTS

| | | | | |
|---|---|---|---|---|
| 5,612,609 | A * | 3/1997 | Choi | 323/210 |
| 8,587,956 | B2 * | 11/2013 | Choutov et al. | 361/763 |
| 8,686,667 | B2 * | 4/2014 | Mishima et al. | 315/307 |
| 8,901,851 | B2 * | 12/2014 | Kuang et al. | 315/307 |
| 2008/0018261 | A1 * | 1/2008 | Kastner | 315/192 |
| 2010/0123410 | A1 * | 5/2010 | Tsai | 315/287 |
| 2011/0175532 | A1 * | 7/2011 | Peng | 315/119 |

FOREIGN PATENT DOCUMENTS

CN 201839477 U 5/2011

* cited by examiner

*Primary Examiner* — Dinh Le
(74) *Attorney, Agent, or Firm* — Michael C. Stephens, Jr.

(57) ABSTRACT

Disclosed are LED driver circuits, and methods of driving LED loads. In one embodiment, an LED driver can include: (i) an SCR coupled to an AC power supply, and configured to generate a DC voltage through a first rectifier circuit; (ii) a first stage conversion circuit having an isolated topology with power factor correction, where the first stage conversion circuit is configured to convert the DC voltage to a first output voltage; (iii) where the first stage conversion circuit includes a transformer having a primary side coupled to the DC voltage, and a secondary side coupled to the first output voltage through a second rectifier circuit; and (iv) a second stage conversion circuit having a non-isolated topology, where the second stage conversion circuit is configured to convert the first output voltage to an output current configured to drive an LED load based on a conducting angle of the SCR.

16 Claims, 6 Drawing Sheets

HIGH-EFFICIENCY LED DRIVER AND DRIVING METHOD

RELATED APPLICATIONS

This application claims the benefit of Chinese Patent Application No. 201210250046.X, filed on Jul. 19, 2012, which is incorporated herein by reference in its entirety.

FIELD OF THE INVENTION

The present invention relates to the field of light-emitting diode (LED) lighting, and more particularly to a high-efficiency LED driver, and an associated driving method.

BACKGROUND

With continuous innovation and rapid development of the lighting industry, along with increasing importance of energy-savings and environmental protection, LED lighting is being increasingly employed as a revolutionary energy-efficient lighting technology. However, due to volt-ampere principles and temperature characteristics, LEDs are more sensitive to current than voltage. Thus, conventional power supplies may not be applicable to directly power LED loads. Therefore, it is important to have an appropriate LED driver when using LED as a lighting source.

SUMMARY

In one embodiment, a light-emitting diode (LED) driver can include: (i) a silicon-controller rectifier (SCR) coupled to an AC power supply, and configured to generate a DC voltage through a first rectifier circuit; (ii) a first stage conversion circuit having an isolated topology with a power factor correction function, where the first stage conversion circuit is configured to convert the DC voltage to a first output voltage; (iii) where the first stage conversion circuit includes a transformer having a primary side coupled to the DC voltage, and a secondary side coupled to the first output voltage through a second rectifier circuit; and (iv) a second stage conversion circuit having a non-isolated topology, where the second stage conversion circuit is configured to convert the first output voltage to an output current configured to drive an LED load based on a conducting angle of the SCR.

In one embodiment, a method of driving an LED load can include: (i) generating a DC voltage by processing an AC power supply through an SCR; (ii) converting the DC voltage to a first output voltage through a first stage conversion circuit having an isolated topology with a power factor correction function; (iii) converting the first output voltage to an output current configured to drive the LED load through a second stage conversion having a non-isolated topology; and (iv) generating a dimming signal configured to dim the LED load according to a conducting angle of the SCR.

Embodiments of the present invention can advantageously provide several advantages (e.g., high efficiency, high reliability, and low cost) over conventional approaches. Other advantages of the present invention may become readily apparent from the detailed description of preferred embodiments below.

DETAILED DESCRIPTION

Reference may now be made in detail to particular embodiments of the invention, examples of which are illustrated in the accompanying drawings. While the invention may be described in conjunction with the preferred embodiments, it may be understood that they are not intended to limit the invention to these embodiments. On the contrary, the invention is intended to cover alternatives, modifications and equivalents that may be included within the spirit and scope of the invention as defined by the appended claims. Furthermore, in the following detailed description of the present invention, numerous specific details are set fourth in order to provide a thorough understanding of the present invention. However, it may be readily apparent to one skilled in the art that the present invention may be practiced without these specific details. In other instances, well-known methods, procedures, processes, components, structures, and circuits have not been described in detail so as not to unnecessarily obscure aspects of the present invention.

Figure 1:
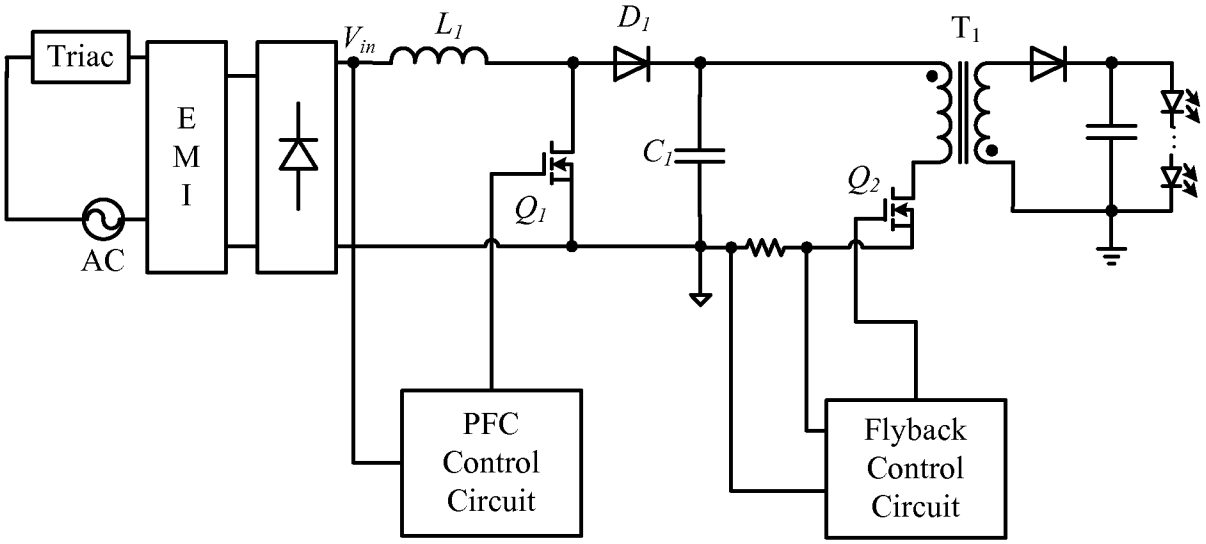
FIG. 1 is a block diagram of an example two-stage LED driver.

FIG. 1 shows a schematic diagram of an example two-stage light-emitting diode (LED) driver. An AC input power supply can be converted to a DC input voltage $V_{in}$ through a silicon-controlled rectifier (SCR) circuit, an anti-electromagnetic interference (EMI) circuit, and a rectifier circuit. The first stage of the LED driver can be a boost pre-modulation circuit with a power factor correction function. The second stage of the LED driver can include a flyback converter to transfer the output voltage of the first stage to the secondary side through an isolated topology. Also, the low-frequency harmonic found in the LED driving current can be filtered for dimming the LED load.

However, when utilising a boost circuit (e.g., when the output voltage is higher than the input voltage), the output voltage may be further increased in wide-output voltage applications with relatively high input voltage. Thus, some circuit components shown in FIG. 1 (e.g., diode $D_1$, switch $Q_1$, switch $Q_2$, and capacitor $C_1$) may need to be relatively high "withstand" or breakdown voltage devices. Also, because the LED driver may operate under high temperatures for long periods of time, capacitor $C_1$ may be implemented as an electrolytic capacitor with a high withstand temperature and a relatively long lifetime. This may result in increased product costs and poor reliability. In addition, a system dimming signal may be taken from the output side and transferred to the flyback control circuit through an opto-coupler, further increasing product costs.

In particular embodiments, an LED driver can modulate a voltage signal output by a first stage conversion circuit to obtain a substantially stable voltage. This may prevent a secondary side of the flyback converter from absorbing energy transferred from a primary side, which might otherwise cause overcharge on an output capacitor when the LED load fails. When some fluctuations are permitted to exist in the output voltage in the first stage conversion circuit, the size and cost of the output capacitor can be reduced. Thus, the capacitance value of the output capacitor can be reduced such that an electrolytic type of capacitor may not be needed, thereby improving overall circuit reliability.

For example, the topology of the second stage conversion circuit can be a non-isolated converter. Also, the second stage conversion circuit can be coupled at the low-voltage side of the transformer, so as to reduce withstand voltage requirements of corresponding components, and to avoid using high withstand voltage components, thereby reducing product costs. An LED driver of particular embodiments can control the LED load current based on an operation result between the dimming signal that represents an SCR conducting angle, and a system dimming signal, thereby further reducing product costs. The system dimming signal at the output-side can be transferred without having to use an opto-coupler, thereby also further reducing product costs.

In one embodiment, an LED driver can include: (i) an SCR coupled to an AC power supply, and configured to generate a DC voltage through a first rectifier circuit; (ii) a first stage conversion circuit having an isolated topology with a power factor correction function, where the first stage conversion circuit is configured to convert the DC voltage to a first output voltage; (iii) where the first stage conversion circuit includes a transformer having a primary side coupled to the DC voltage, and a secondary side coupled to the first output voltage through a second rectifier circuit; and (iv) a second stage conversion circuit having a non-isolated topology, where the second stage conversion circuit is configured to convert the first output voltage to an output current configured to drive an LED load based on a conducting angle of the SCR.

The output current that is configured to drive the LED load may be a substantially constant current in many applications. In other cases, the output current may be within a range of a predetermined value. For example, this output current may be substantially constant for a given LED light intensity, and the current may be configured to change to accommodate dimming functionality. In this case, the current may gradually change, or may change in relatively small steps to different constant levels to accommodate dimming. In any case, the output current for driving the LED load may be based on the SCR conducting or conduction angle. A conduction angle in an SCR is the phase angle relative to the power line at which point the gate is fired to commit the anode to conduct to the cathode.

Figure 2:
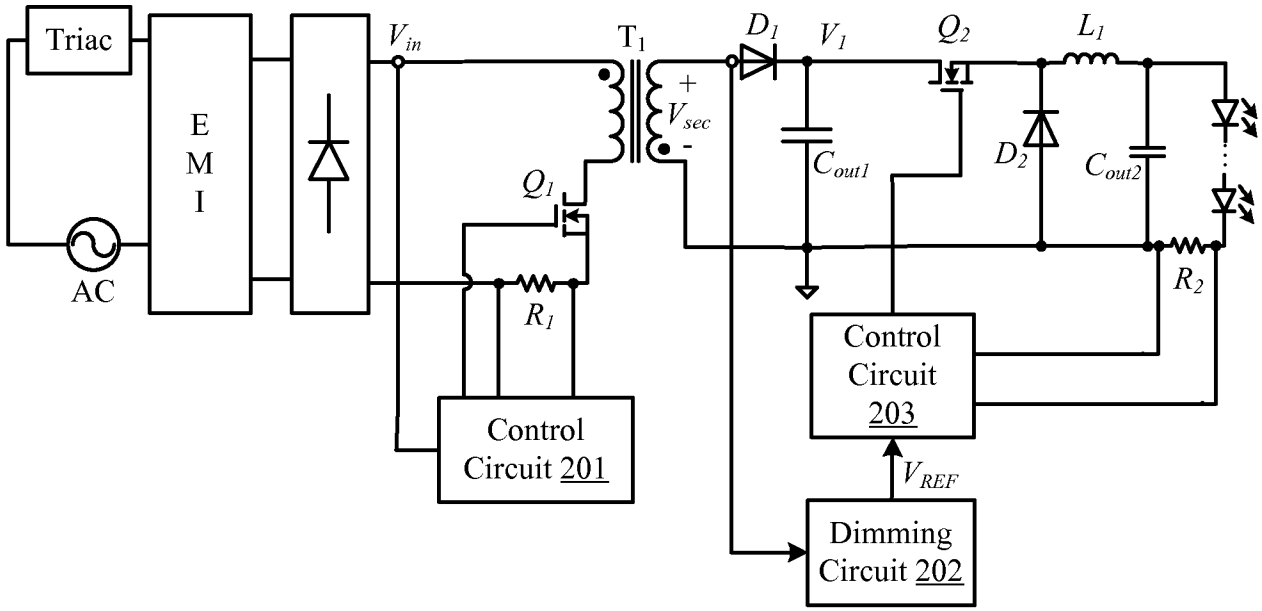
FIG. 2 is a block diagram of an example LED driver in accordance with embodiments of the present invention.

Referring now to FIG. 2, shown is a block diagram of an example LED driver in accordance with embodiments of the present invention. This example LED driver can receive an AC power supply, and obtain DC voltage $V_{in}$ after being processed by an SCR circuit, an EMI anti-electromagnetic interference circuit, and a rectifier circuit. Then, DC voltage $V_{in}$ can be converted to a certain output voltage (e.g., a predetermined output voltage, or a predetermined range of possible output voltages), and an output current to drive the LED load through first and second stage conversion circuits.

For example, the first stage conversion circuit can be an isolated topology with a power factor correction function, and may be used to convert DC voltage $V_{in}$ to a substantially stable first output voltage $V_1$. In this particular example, the first stage conversion circuit can include transformer $T_1$ having a primary side that couples to DC voltage $V_{in}$ via switch $Q_1$, and a secondary side that couples to output voltage $V_1$ via a rectifier circuit $D_1$. The first stage conversion circuit can include a flyback converter and control circuit 201.

The flyback converter can connect to the rectifier circuit to receive DC voltage $V_{in}$. Sampling resistor $R_1$ can connect to primary side power switch $Q_1$ of the flyback converter to sample the current of the primary side. Generally, primary side control methods can be used, and a voltage signal that represents output voltage $V_1$ can be sampled through an auxiliary winding and voltage-dividing resistors. Based on a voltage signal that represents output voltage $V_1$, DC voltage $V_{in}$ and the voltage on resistor $R_1$ that represents the primary-side current, control circuit 201 can control operation of primary side power switch $Q_1$ to convert DC voltage $V_{in}$ to output voltage $V_1$. Control circuit 201 may also ensure that the input voltage and the input current of the flyback converter are in a same phase so as to improve the power factor, and to achieve relatively high energy conversion efficiency.

Because voltage $V_1$ may experience about twice the time of AC power frequency ripple, an output capacitor at the output terminal may be utilized to filter this ripple. In general, output voltage $V_1$ may be allowed to have a predetermined fluctuation in order to reduce the size and cost of output capacitor $C_{out1}$. As control circuit 201 can control output voltage $V_1$ to be maintained as substantially stable, the capacitance value of output capacitor $C_{out1}$ can be reduced (e.g., by avoiding use of an electrolytic capacitor) to further improve the reliability of the circuit. However, a highest voltage of output voltage $V_1$ may be limited (e.g., less than a predetermined maximum) to protect output capacitor $C_{out1}$ and other output-side components.

The main circuit topology of the second stage conversion circuit can be non-isolated. For example, the second stage conversion circuit topology can be a non-isolated buck circuit that includes switch $Q_2$, diode $D_2$, inductor $L_1$, and capacitor $C_{out2}$. The second stage conversion circuit can also include dimming circuit 202 and control circuit 203. By changing the SCR conducting angle, the power received by the first stage conversion circuit can be accordingly changed. Thus, a waveform of output voltage $V_1$ can also change such that secondary winding voltage $V_{sec}$ of the flyback converter can also be accordingly changed. Dimming circuit 202 can receive secondary winding voltage $V_{sec}$, and may output dimming signal $V_{REF}$ that represents the SCR conducting angle.

When using sampling resistor $R_2$ to series connect to the LED load, the voltage across $R_2$ can represent the current flowing through the LED load. Control circuit 203 can receive the voltage of sampling resistor $R_2$ that represents the LED current signal, and dimming signal $V_{REF}$. In this way, a switching operation of switch $Q_2$ of the second stage conversion circuit can be controlled to convert output voltage $V_1$ to a certain (e.g., predetermined value, predetermined range, or otherwise effective current level) output current to drive the LED load.

When the SCR conducting angle is changing, control circuit 201 can substantially maintain the stability of output voltage $V_1$ by controlling the switching operation of primary side power switch $Q_1$. Meanwhile, according to the changes of secondary winding voltage $V_{sec}$, dimming circuit 202 can adjust dimming signal $V_{REF}$ correspondingly. Also, according to dimming signal $V_{REF}$, control circuit 203 can control switch $Q_2$ in the main circuit such that the LED current can be adjusted to substantially match the SCR conducting angle. In this way, dimming can be realized, and a substantially constant current can be maintained in order to prevent flashing of the LED lights.

In this particular example, sampling resistors are used to sample the primary side current of the flyback transformer and the LED load current. Those skilled in the art will recognize that other circuit implementations for the control circuit and/or the flyback converter can be applied in particular embodiments. In addition, the first stage conversion circuit can also adopt other isolated topologies (e.g., forward, pushpull, bridge converter, etc.), while the topology structure of the second stage conversion circuit is not limited to the non-isolated buck circuit as exemplified. Any suitable non-isolated topology (e.g., non-isolated boost circuit, non-isolated buck-boost circuit, etc.) may also be utilized for the second stage conversion circuit.

Thus, the LED driver in the example shown in FIG. 2 can modulate the voltage signal output by the first stage conversion circuit in order to ensure the circuit operates in a substantial stable state. In addition, this LED driver implementation can avoid excessive charging of the capacitor, as the secondary side of the flyback converter may absorb the energy from the primary side when the LED load fails. Further, when some fluctuations of output voltage are permitted (e.g., for particular LED applications) in the first stage conversion circuit, the size and cost of the output capacitor can be reduced, and the capacitance value of the output capacitor can be reduced (e.g., so as to save an electrolytic capacitor), to further improve the reliability of the entire circuit.

The topology structure of the second stage conversion circuit can be a non-isolated converter coupled at a low-voltage side of the transformer, but without a high-voltage power stage circuit. In this case, the withstand voltage requirements of corresponding components (e.g., switches, diodes, etc.) may be reduced, so high withstand voltage components may not be needed, thus reducing product costs. In this way, an LED driver in particular embodiments may realize increased efficiency and reliability, as well as reduced costs, relative to conventional approaches.

Figure 3:
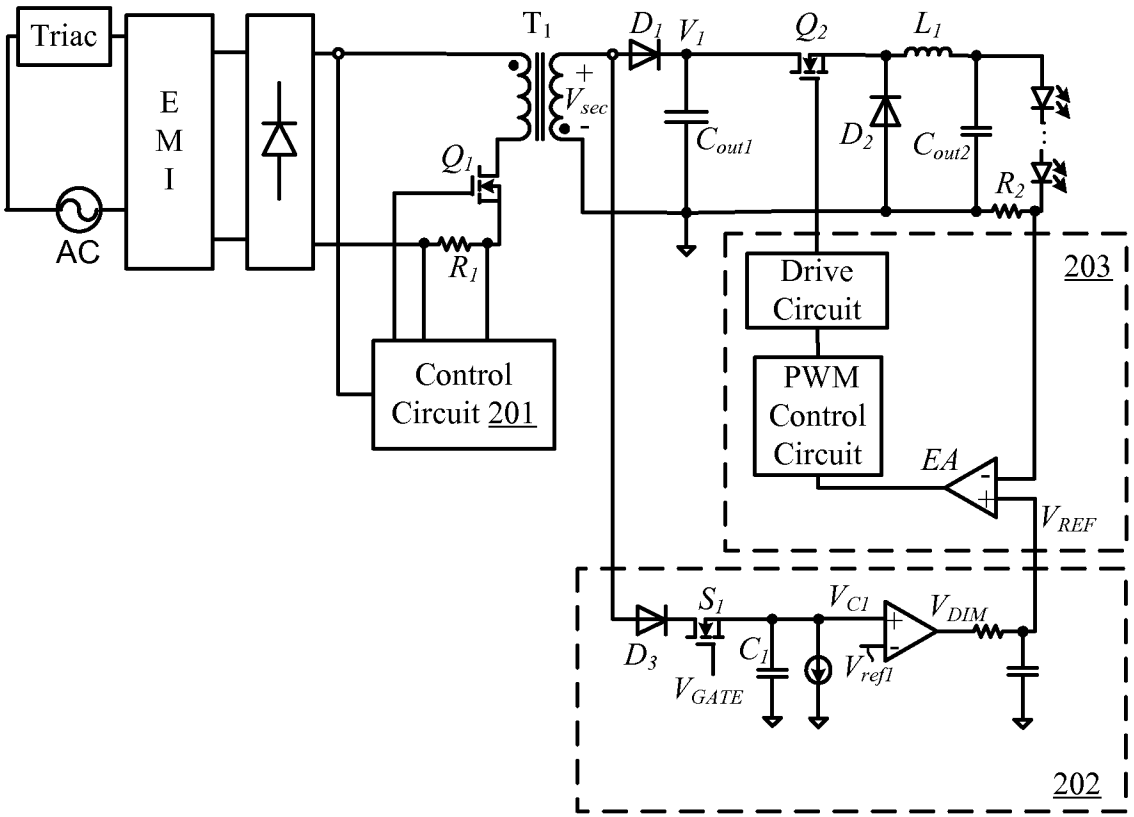
FIG. 3 is a block diagram of another example LED driver in accordance with embodiments of the present invention.

Referring now to FIG. 3, shown is a block diagram of another LED driver in accordance with embodiments of the present invention. In particular, example circuit structures and operations of dimming circuit 202 and control circuit 203 will be described. Dimming circuit 202 can include a square wave signal generating circuit used to receive an electrical signal of the secondary side circuit in the first stage conversion circuit. Dimming circuit 202 may output a square wave signal that represents the SCR conducting angle as the dimming signal.

The square wave signal generating circuit of 202 can include switch $S_1$, capacitor $C_1$, and a discharge circuit. The first power terminal of switch $S_1$ can receive secondary winding voltage $V_{sec}$ of the flyback converter, and the output of the second power terminal can provide charging current to capacitor $C_1$. In order to ensure current flows in one direction, diode $D_3$ can be added between the first power terminal of the switch $S_1$ and the secondary winding. For example, the discharging circuit may be a current source or a resistor. In this particular example, a current source can connect to capacitor $C_1$ in parallel to provide a discharging circuit.

Figure 4:
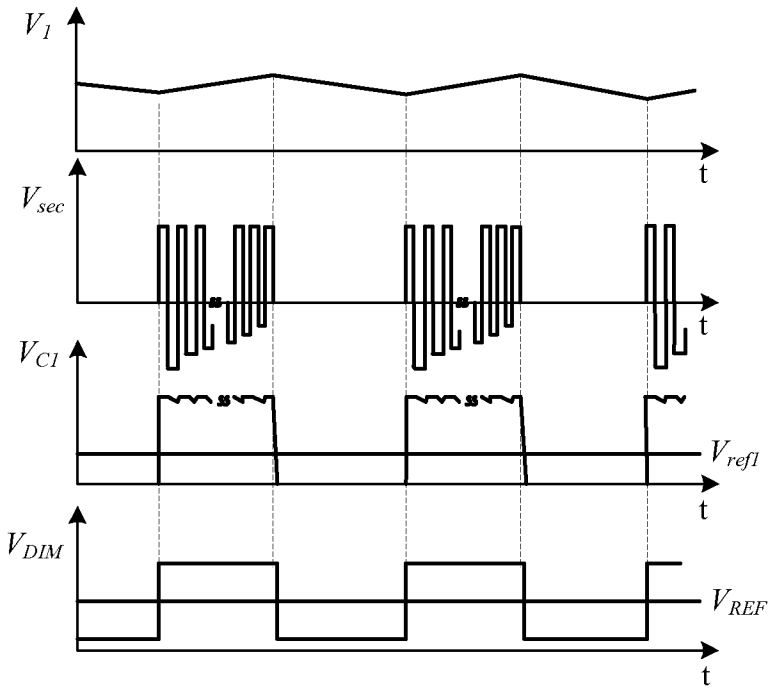
FIG. 4 is an example operational waveform diagram of the example dimming circuit in the LED driver of FIG. 3.

The following describes the operation process of the dimming circuit shown in FIG. 3 in conjunction with the waveform diagram in FIG. 4. In this particular example, the first stage conversion circuit may operate intermittently based on the SCR conducting angle. For example, the SCR conducting angle can be detected through the control circuit 201, and according to the angle, the flyback converter can be intermittently enabled and disabled, such that the waveforms of output voltage $V_1$ and secondary winding voltage $V_{sec}$ of the flyback converter shown in FIG. 4 can be generated. For example, the waveforms of secondary winding voltage $V_{sec}$ can stable at the positive peak, while the negative peak may be the high-frequency pulses changing along with the AC input voltage with a frequency in a range of from about 20 kHz to about 200 kHz.

Control signal $V_{GATE}$ of switch $S_1$ can be a constant voltage with an amplitude less than the voltage amplitude of the secondary winding. For example, the amplitude of secondary winding voltage $V_{sec}$ may be larger than about 10V in some applications. Generally, control signal $V_{GATE}$ can be a constant voltage in a range of from about 3V to about 10V.

When the first stage conversion circuit is allowed to function according to the SCR conducting angle, primary side power switch $Q_1$ can operate at a high frequency. When primary side power $Q_1$ is turned off and secondary winding voltage $V_{sec}$ is positive, capacitor $C_1$ can be charged by turning on switch $S_1$, and the amplitude of voltage $V_{C1}$ across capacitor $C_1$ can be the difference between $V_{GATE}$ and the conducting threshold value of switch $S_1$. When primary side power switch $Q_1$ is turned on and secondary winding voltage $V_{sec}$ is negative, capacitor $C_1$ can slowly discharge via the current source, and voltage $V_{C1}$ may decrease until secondary winding voltage $V_{sec}$ turns to a positive voltage again.

The waveform of voltage $V_{C1}$ across capacitor $C_1$ can be a square wave signal that represents the SCR conducting angle, as shown in FIG. 4. However, since there are some fluctuations that exist in the waveform of voltage $V_{C1}$, voltage $V_{C1}$ may be input to a non-inverting input terminal of a comparator. The inverting input terminal of the comparator can receive reference signal $V_{ref1}$, which may be smaller than the amplitude of voltage $V_{C1}$. If $V_{ref1}$ is set to be about 1V, the output of the comparator can turn out to be a more regular square wave signal $V_{DIM}$. The square wave signal $V_{DIM}$ can be used directly as the dimming signal for control circuit 203 for dimming the LED load.

However, due to possibly inconsistent performance of various SCRs, square wave signal $V_{DIM}$ may have a frequency of less than about 100 Hz, and human eyes may detect LED flashing at such frequencies. Therefore, in order to prevent the LED flashing effect, an averaging circuit including a resistor and a capacitor can be used to average square wave signal $V_{DIM}$ to obtain dimming signal $V_{REF}$. Dimming signal $V_{REF}$ can be used as a reference value of the output LED current to realize linear dimming for the LED load. Also, dimming signal $V_{REF}$ can be compared with a certain frequency (e.g., a frequency greater than about 100 Hz) triangular wave to generate a new stable square wave to realize ON/OFF dimming of the LED load. In the particular example of FIG. 3, linear dimming may be employed.

Control circuit 203 can include an error operation circuit (EA), a pulse-width modulation (PWM) circuit, and a drive circuit. The error operation circuit can use an error amplifier to receive a voltage across sampling resistor $R_2$ that represents the LED current signal, and the dimming signal, to generate an error signal. The PWM circuit can output a PWM control signal to control operation of switch $Q_2$ in the second stage conversion circuit through the drive circuit based on the error signal.

Figure 5:
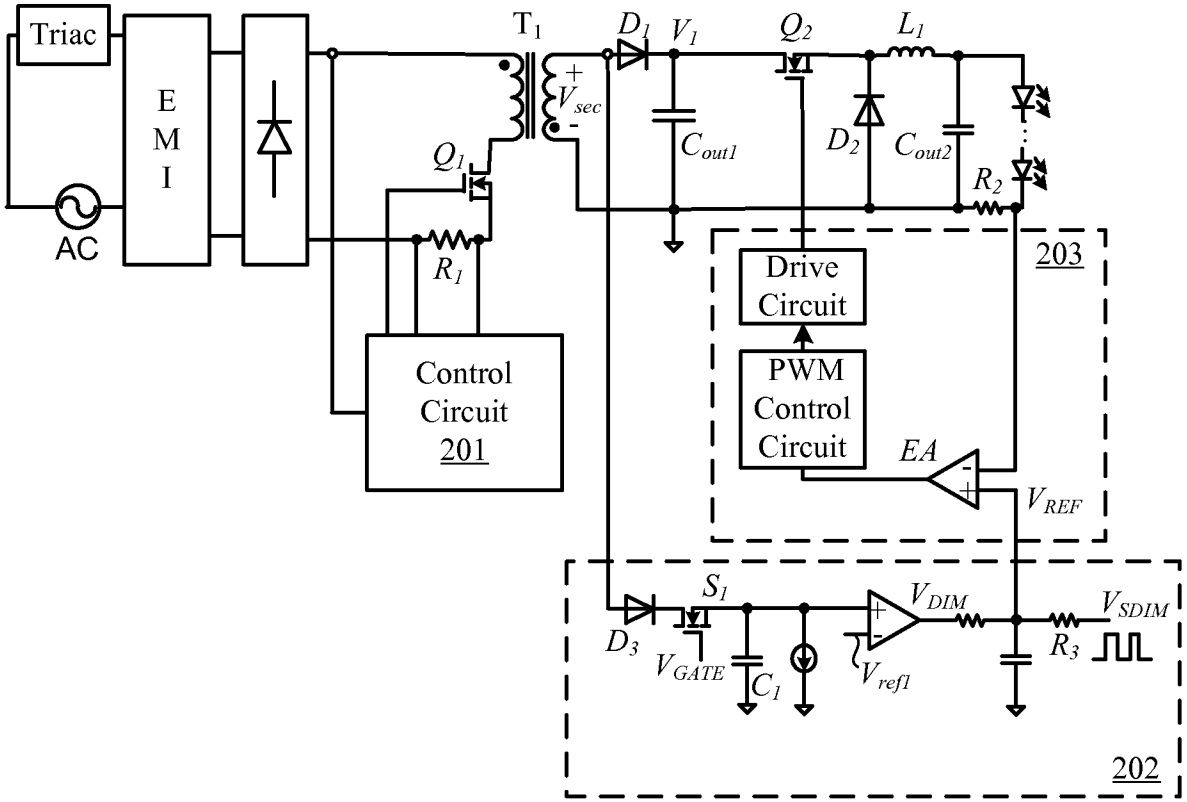
FIG. 5 is a block diagram of another example LED driver in accordance with embodiments of the present invention.

Referring now to FIG. 5, shown is a block diagram of another example LED driver in accordance with embodiments of the present invention. In order to realize LED load dimming according to system needs on the basis of SCR dimming, square wave signal $V_{SDIM}$ can be connected to a common connection point of the resistor and the capacitor in the averaging circuit of dimming circuit 202 through resistor $R_3$. Thus, dimming signal $V_{DIM}$ that represents the SCR conducting angle, and square wave signal $V_{SDIM}$, can be superimposed and processed to generate dimming signal $V_{REF}$.

As can be seen from this particular example LED driver, the LED load current can be controlled based on an operation result (e.g., superimposition) of a signal that represents system dimming (e.g., $V_{SDIM}$) and a dimming signal that represents the SCR conducting angle (e.g., $V_{DIM}$). In this way, the signal that represents the system dimming (e.g., $V_{SDIM}$) at the output side may not be required to be transmitted through an opto-coupler, thus reducing product costs.

In one embodiment, a method of driving an LED load can include: (i) generating a DC voltage by processing an AC power supply through an SCR; (ii) converting the DC voltage to a first output voltage through a first stage conversion circuit having an isolated topology with a power factor correction function; (iii) converting the first output voltage to an output current configured to drive the LED load through a second stage conversion having a non-isolated topology; and (iv) generating a dimming signal configured to dim the LED load according to a conducting angle of the SCR.

Figure 6:
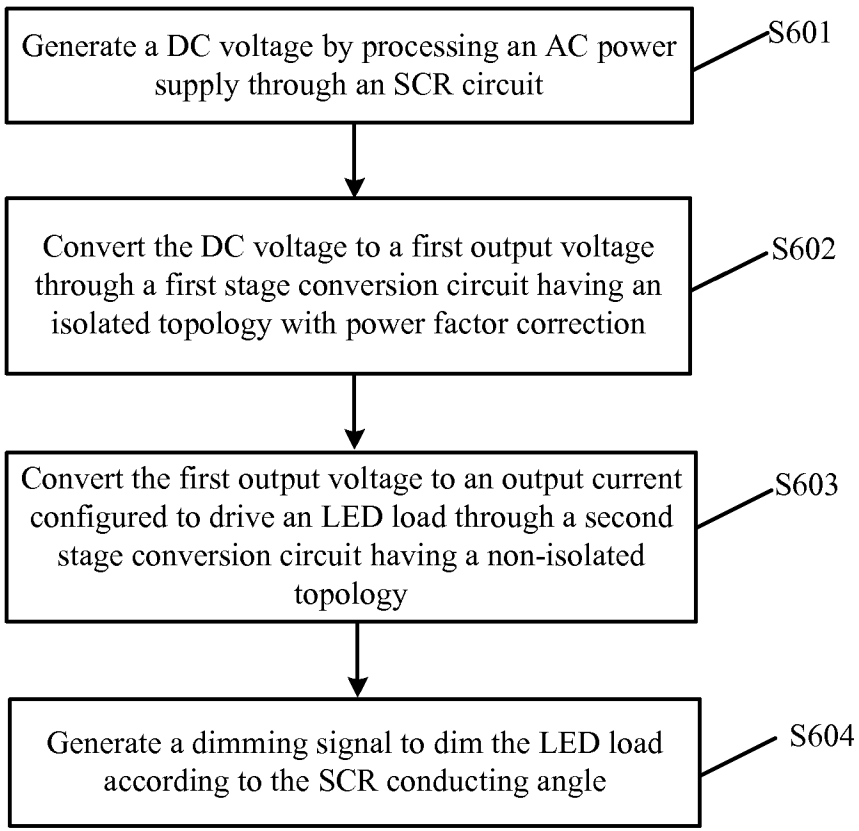
FIG. 6 is a flow diagram of an example LED driving method in accordance with embodiments of the present invention.

Referring now to FIG. 6, shown is a flow diagram of an example LED driving method, which can include the following steps. At S601, a DC voltage can be generated by processing an AC power through a SCR circuit. At S602, the DC voltage can be converted to an output voltage $V_1$ through a first stage conversion by using an isolated topology with a power factor correction function. At S603, output voltage $V_1$ can be converted to a certain output current to drive an LED load through a second stage conversion by using a non-isolated topology. At S604, a dimming signal can be generated to dim the LED load according to the SCR conducting angle.

For example, step S601 can also include making the first stage conversion circuit operate intermittently, such as according to the SCR conducting angle. Also, step S603 can include dimming the LED load according to an operation result (e.g., superimposition) of the dimming signal (e.g., $V_{DIM}$) that represents the SCR conducting angle and the signal that represents the system dimming (e.g., $V_{SDIM}$), as shown in the example dimming circuit 202 of FIG. 5.

The embodiments were chosen and described in order to best explain the principles of the invention and its practical applications, to thereby enable others skilled in the art to best utilize the invention and various embodiments with modifications as are suited to the particular use contemplated. It is intended that the scope of the invention be defined by the claims appended hereto and their equivalents.

What is claimed is:

1. A light-emitting diode (LED) driver, comprising:

a) a silicon-controller rectifier (SCR) coupled to an AC power supply, and configured to generate a DC voltage through a first rectifier circuit;

b) a first stage power converter circuit having an isolated topology with a power factor correction function, wherein said first stage power converter circuit is configured to convert said DC voltage to a first output voltage;

c) said first stage power converter circuit comprising a transformer having a primary winding coupled to said DC voltage, and a secondary winding coupled to said first output voltage through a second rectifier circuit;

d) a second stage power converter circuit having a non-isolated topology, wherein said second stage power converter circuit is configured to convert said first output voltage to an output current configured to drive an LED load based on a conduction angle of said SCR;

e) a dimming circuit coupled to said first stage power converter circuit, and configured to output a dimming signal that represents said SCR conduction angle, wherein said dimming circuit comprises a square wave signal generating circuit coupled to said secondary winding of said transformer, and is configured to output a square-wave signal as said dimming signal; and f) a first control circuit configured to receive an LED current signal and said dimming signal, and to control a second stage power switch to convert said first output voltage to said output current to drive said LED load.

2. The LED driver of claim 1, wherein said first stage power converter circuit comprises:

a) a flyback converter coupled to said first rectifier circuit, and configured to receive said DC voltage; and b) a second control circuit coupled to said DC voltage and a gate of a primary side power switch of said flyback converter, wherein said second control circuit is configured to control conversion of said DC voltage to said first output voltage by controlling said primary side power switch, and wherein an input voltage is in a same phase with an input current of said flyback converter.

3. The LED driver of claim 1, wherein said non-isolated topology of said second stage power converter circuit comprises a non-isolated buck power converter circuit.

4. The LED driver of claim 1, wherein said non-isolated topology of said second stage power converter circuit comprises a non-isolated boost power converter circuit.

5. The LED dimming circuit of claim 1, wherein said dimming circuit further comprises an averaging circuit configured to average said square-wave signal through said averaging circuit to generate said dim in signal.

6. The LED driver of claim 1, wherein said dimming signal and a signal that represents system dimming are configured to dim said LED load.

7. The LED driver of claim 1, wherein said first stage power converter circuit is configured to operate intermittently according to said SCR conduction angle.

8. The LED driver of claim 1, wherein said non-isolated topology of said second stage power converter circuit comprises a non-isolated buck-boost power converter circuit.

9. A method of driving a light-emitting diode (LED) load, the method comprising:

a) generating a DC voltage by rectifying an AC power supply through a silicon-controller rectifier (SCR) and a first rectifier circuit;

b) converting said DC voltage to a first output voltage through a first stage power converter circuit having an isolated topology with a power factor correction function, wherein said first stage power converter circuit comprises a transformer having a primary winding coupled to said DC voltage, and a secondary winding coupled to said first output voltage through a second rectifier circuit;

c) converting said first output voltage to an output current configured to drive said LED load through a second stage power converter circuit having a non-isolated topology, wherein a first control circuit receives an LED current signal and a dimming signal, and controls a second stage power switch for converting said first output voltage to said output current to drive said LED load; and d) generating, by a dimming circuit coupled to said first stage power converter circuit, said dimming signal for dimming said LED load according to a conduction angle of said SCR, wherein said dimming circuit comprises a square wave signal generating circuit coupled to said secondary winding of said transformer, said dimming circuit generating a square-wave signal as said dimming signal.

10. The LED driving method of claim 9, further comprising operating said first stage power converter circuit intermittently according to said SCR conduction angle.

11. The LED driving method of claim 10, further comprising dimming said LED load according to said dimming signal representing said SCR conduction angle and a signal representing system dimming.

12. The LED driving method of claim 9, wherein said first stage power converter circuit comprises:

a) a flyback converter coupled to said first rectifier circuit, and receiving said DC voltage; and b) a second control circuit coupled to said DC voltage and a gate of a primary side power switch of said flyback converter, said second control circuit controlling conversion of said DC voltage to said first output voltage by controlling said primary side power switch, wherein an input voltage is in a same phase with an input current of said flyback converter.

13. The LED driving method of claim 9, wherein said non-isolated topology of said second stage power converter circuit comprises a non-isolated buck power converter circuit.

14. The LED driving method of claim 9, wherein said non-isolated topology of said second stage power converter circuit comprises a non-isolated boost power converter circuit.

15. The LED driving method of claim 9, wherein said non-isolated topology of said second stage power converter circuit comprises a non-isolated buck-boost power converter circuit.

16. The LED driving method of claim 9, further comprising averaging, by an averaging circuit, said square-wave signal to generate said dimming signal.

* * * * *